United States Patent [19]

Reymann et al.

[11] Patent Number: 4,745,860

[45] Date of Patent: May 24, 1988

[54] SMALL SCALE SEMI-SUBMERSIBLE BOAT FOR NAVAL COMBAT

[75] Inventors: Jacques A. Reymann; Daniel Thoumyre, both of Brussels, Belgium

[73] Assignee: Swimart S.A., Brussels, Belgium

[21] Appl. No.: 31,625

[22] Filed: Mar. 30, 1987

[30] Foreign Application Priority Data

Apr. 24, 1986 [LU] Luxembourg ..... 86408

[51] Int. Cl.[4] ..... F42B 4/00

[52] U.S. Cl. ..... 102/354; 114/335; 114/345; 114/360; 114/123

[58] Field of Search ..... 102/341, 354; 114/335, 114/341, 342, 288, 289, 345, 360, 123; 405/207

[56] References Cited

U.S. PATENT DOCUMENTS

| | | | |
|---|---|---|---|
| 1,429,941 | 9/1922 | Flamm | 114/341 |
| 2,724,132 | 11/1955 | Shoup et al. | 114/360 |
| 3,948,056 | 4/1976 | Sumner | 405/207 |
| 3,961,489 | 6/1976 | Mo | 405/207 |
| 4,102,292 | 7/1978 | Hunter et al. | 114/270 |
| 4,164,186 | 8/1979 | Beatty et al. | 102/341 |
| 4,365,557 | 12/1982 | Couture et al. | 102/341 |
| 4,413,583 | 11/1983 | Elling et al. | 114/123 X |
| 4,458,618 | 7/1984 | Tuffier | 114/360 X |

*Primary Examiner*—Peter A. Nelson

*Attorney, Agent, or Firm*—Sughrue, Mion, Zinn, Macpeak & Seas

[57] ABSTRACT

This invention relates to a small scale semi-submersible boat for naval combat comprising a hull of which a first, water-tight part is insubmersible and a second part is submersible.

In the submersible part of the hull is accommodated at least one balloon or caisson serving as float which has a wall capable of being perforated and is inflated by means of a gas to enable the boat to float, the said boat also having a device for perforating the wall of the aforesaid balloon or caisson of a similar boat of an opponent, so as to damage the buoyancy of the opponent's boat.

9 Claims, 5 Drawing Sheets

SMALL SCALE SEMI-SUBMERSIBLE BOAT FOR NAVAL COMBAT

PRIOR ART

GB-A-559 254 (D1) discloses a boat suitable for use as a toy, which has a target capable of pivoting about an axis. When the target is hit by a missile, its rocking movement enables water to enter the hull of the boat through an opening in the hull below the water line so that the boat at least partly sinks. This boat may be equipped with a motor housed in a water-tight compartment.

DE-C-293 252 (D2) discloses a toy boat having two parts which form floating bodies when they are attached to one another. These two parts can be separated when a disc serving as target is hit by a projectile such as a torpedo. When the two parts of the boat are separated, water can enter and cause it to sink.

GB-A-648 636 (D3) discloses a toy boat in which the hull has one or more targets connected by a catapult system to the bridge of the boat and to turrets, masts and funnels on this bridge. When a projectile hits a target, the bridge or one of the elements on it is thrown upwards.

Lastly, the document SPIELZEUG, February 1984, page 566, Bamberg, GBR, discloses in "Die Technotoy Neuheiten fanden bei Fernsehen und Presse grossen Anklang" (The Technotoy Novelties were enthusiastically received on television and by the press), vessels such as submarines whose movements are remote controlled by electronic means.

The boats usable as toys described in documents D1 to D3 require the use of projectiles such as missiles, torpedoes, shells, etc.

BRIEF DESCRIPTION OF THE INVENTION

The present invention relates to a small scale semi-submersible boat for naval combat, comprising a hull one part of which is water-tight and insubmersible and may contain a control mechanism for the boat while the other part is submersible.

It is known that naval combat games are normally played on a sheet of paper with pencil.

The object of the present invention is a small scale model of a real boat capable of floating on water (for example on a lake, a swimming pool, a basin or a bathtub) and having features which enable it to take part in a real fight.

The present invention has as its object semi-submersible boats which can be used as toys for a naval combat game in which the boats can be put out of action by collision between the boats without requiring the use of projectiles.

The invention is based on the idea of providing balloons or caissons with perforatable walls on board a boat. These serve as floats and can easily be replaced when they have been perforated.

According to the present invention, the small scale semi-submersible boat for naval combat, which comprises a hull, one part of which is water-tight and insubmersible and may contain a control mechanism for the boat while the other part is submersible, is essentially characterized in that the submersible part of the hull contains at least one balloon or caisson serving as float which has a wall capable of being perforated and which is inflated by means of a gas to enable the boat to float on water. This boat also has a device for perforating the aforesaid wall of the balloon or caisson of an opponent's similar boat so as to affect or reduce the buoyancy of the opponent's boat.

In a first embodiment of the boat according to the invention, the perforating device consists of a spur which is directed outwards from the boat and is so placed that it can directly perforate the wall of the balloon or caisson of an opponent's boat through at least one window which serves as target in the hull of the opponent's boat.

In another embodiment of the boat according to the invention, the perforating device consists of a spur which is directed towards the inside of the boat and is mounted on a support connected to the hull but is displaceable in relation to the hull when pushed by an opponent's boat. In this other embodiment of the invention, the spur may be carried either by a deformable membrane on the hull of the boat or by a lever hinged to the hull, the membrane or lever serving as target.

DETAILED DESCRIPTION OF THE INVENTION

Other features and details of the invention will appear from the description given below with reference to the attached drawings which show schematically and only by way of example some embodiments of a boat according to the invention.

In these drawings.

Identical elements in the various Figures are marked by the same reference numerals.

Figure 1:
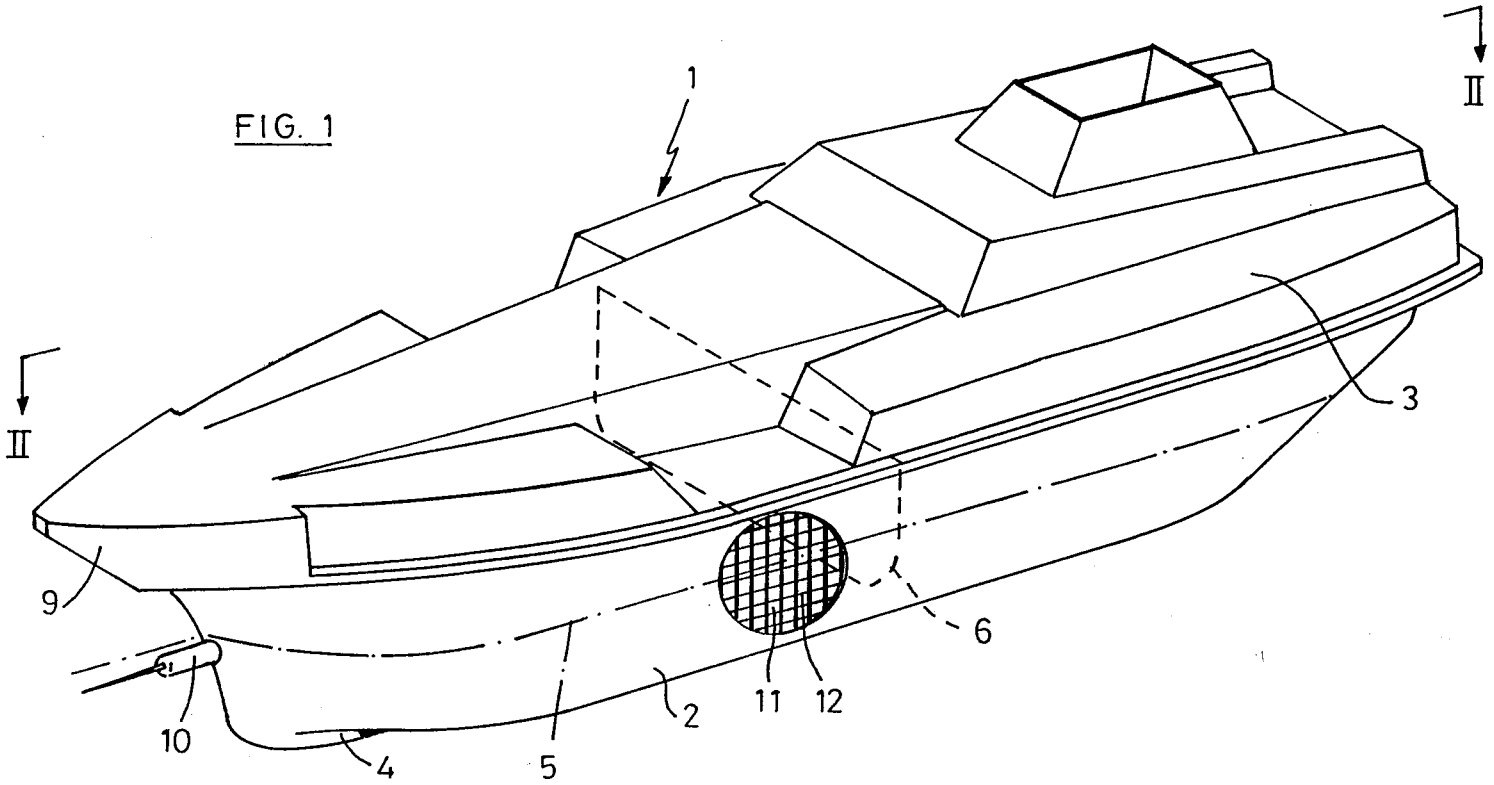
FIG. 1 is a perspective view of a boat according to the invention.

The boat 1 shown in FIG. 1 comprises a hull 2 and a superstructure 3. This superstructure 3 is detachable and is removably fixed water-tightly into the hull 2 which has a keel 4.

The water-line of the boat 1 is indicated in the drawing by a dash-dot line 5.

Figure 2:
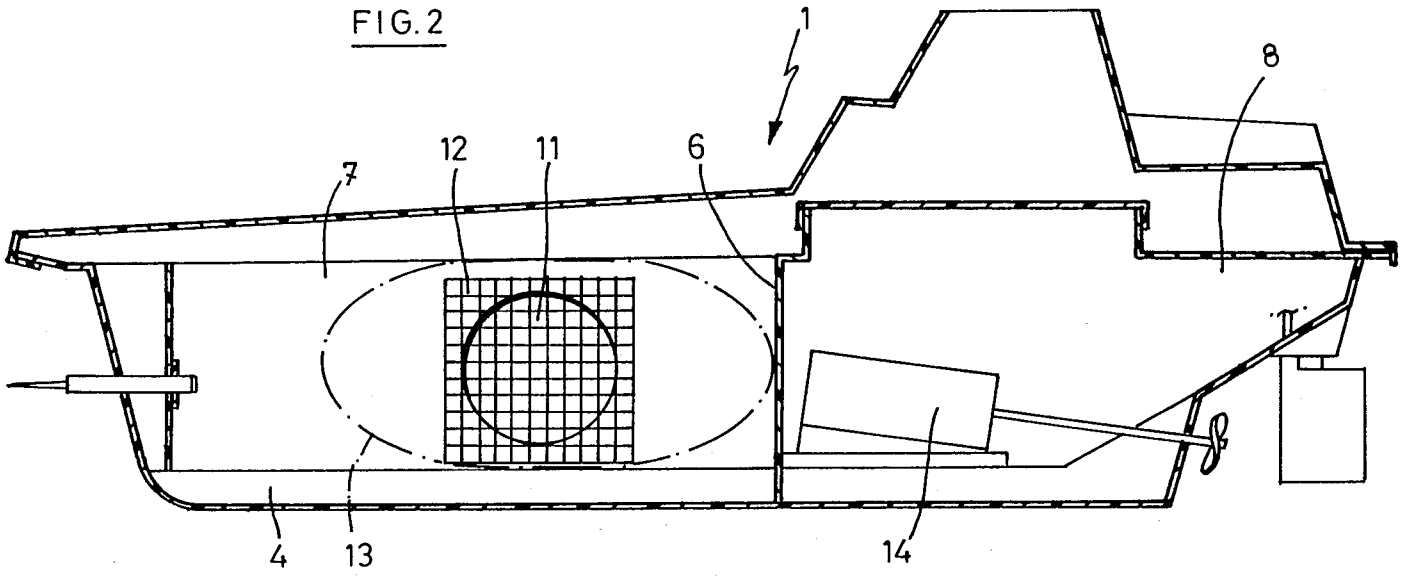
FIG. 2 is a section taken on the line II—II of FIG. 1.

A partition 6 shown in broken lines in FIG. 1 and solid lines in FIG. 2 divides the boat into two parts or compartments, namely a front compartment 7 and a rear compartment 8 (see FIG. 2). The front compartment 7 is partially submersible but the rear compartment 8 is insubmersible and is separated water-tightly from the front compartment 7. Compartment 8 contains electronic devices which determine the movements of the boat 1 on water in known manner.

In the stem 9 and below or at the level or above the level of the water-line 5, the boat has a weapon in the form of a pointed spur 10. On the port side and/or the starboard side, the boat 1 has a window 11 which opens into the front compartment 7 and may be fitted with a grill 12. The spur 10 may have some other form instead of being pointed, for example it may have a sharp edge.

Figure 3:
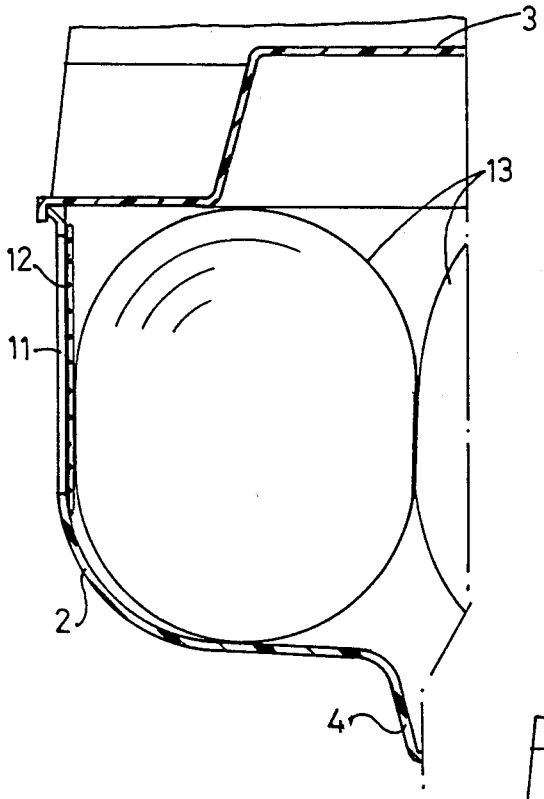
FIG. 3 is a partial section through the hull of a boat, showing one embodiment of a target.

The front compartment 7 contains at least one balloon or caisson 13 which is inflated by a gas, e.g. air, and serves as float. The boat may be provided with two balloons 13 (see FIG. 3) each bearing, when inflated, against a window 11 provided on the port side and the starboard side, respectively, in the front compartment 7 of the hull 2 of the boat 1.

The movements of the boat 1 on a mass of water are remote controlled in known manner by radioelectric waves emitted from a station outside the boat and received by a receiver 14 accommodated in the water-tight and insubmersible rear compartment or part 8 of the boat. This receiver 14 controls the propeller and rudder of the boat 1.

When the boat 1 strikes by means of its weapon 10 a target formed by one of the floats 13 situated across one of the window grilles 11, the float 13 is perforated and deflated. The buoyancy of the boat is thereby affected and the front compartment 7 sinks into the water.

If the compartment 7 has two floats 13 and if, for example, the float 13 situated behind a window 11 on the port side of the boat is perforated by a pointed spur 100 of an opponent's boat, the buoyancy of the boat is only partially destroyed and the boat lists slightly to port side. It is then up to the opponent to pursue the attack and perforate the float 13 situated behind the window 11 on the starboard side. When this float 13 is also perforated, the prow of the attached boat sinks under water.

A boat which has been partially struck on the port side or the starboard side is still capable of attacking an opponent's boat even though its bouyancy has been reduced.

If the first-mentioned boat succeeds in touching one of the targets of the opponent's boat, then the two protagonists are equally handicapped. The defeat of one of the boats will be complete when all its targets have been hit and the boat will then be partially submerged as indicated earlier.

Figure 4:
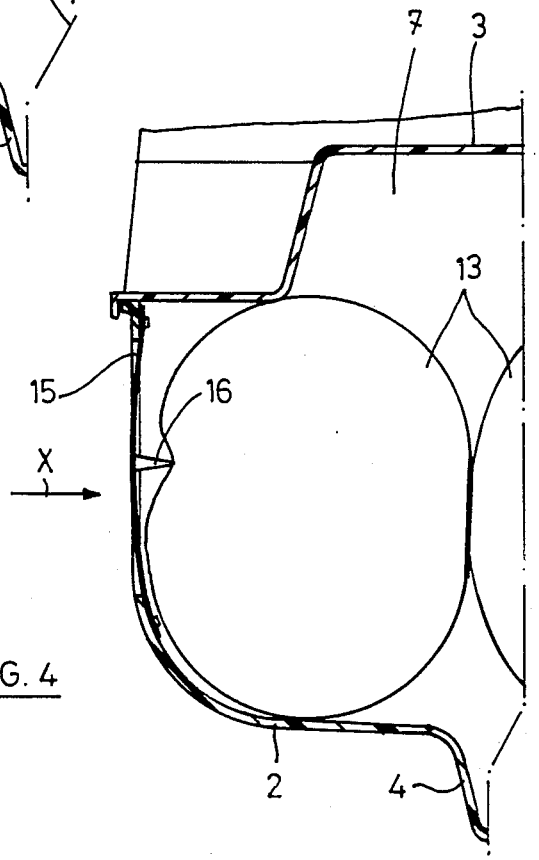
FIG. 4 is a section similar to that of FIG. 3 showing a second embodiment of a target.

FIG. 4 shows an embodiment in which the windows 11 are replaced by membranes 15 serving as targets which close the openings in the hull 2 of the boat under the water-line 5. Each membrane carries a spur 16 which is directed towards the interior of the hull 2. In that case, the weapon of attack may consist of any part projecting from the hull and need not be pointed but may be rounded at the tip in the form of a tongue, bulb or the like. When this projecting part touches the membrane 15 in the direction of the arrow X, the spur 16 attached to this membrane 15 also moves in the direction of the arrow X and perforates the adjacent float 13.

Water can then enter the hull 2 through an opening (not shown) situated below the water line so as to damage the buoyancy of the boat.

Figure 5:
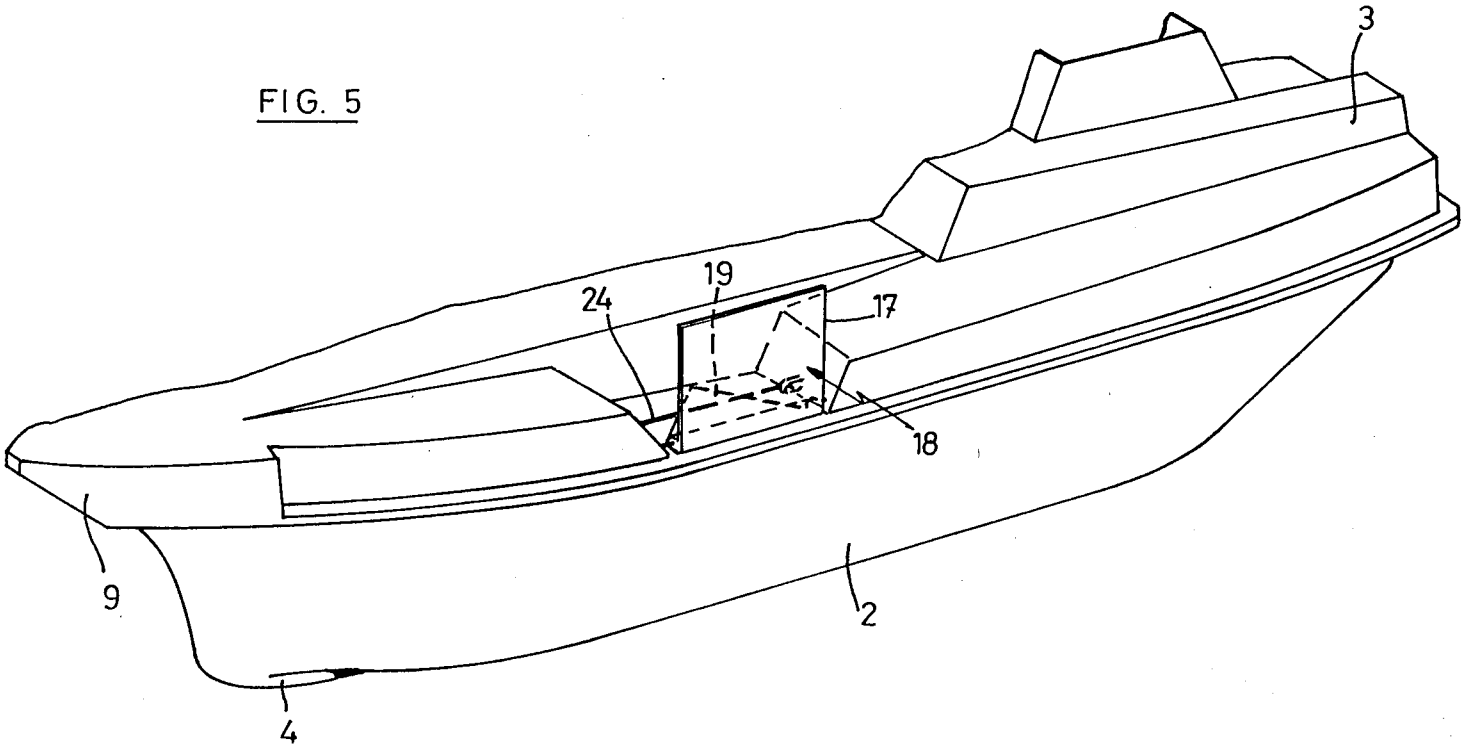
FIGS. 5 and 6 show, in perspective view and in transverse section, respectively, a third embodiment of a target hinged to the hull of a boat.
Figure 6:
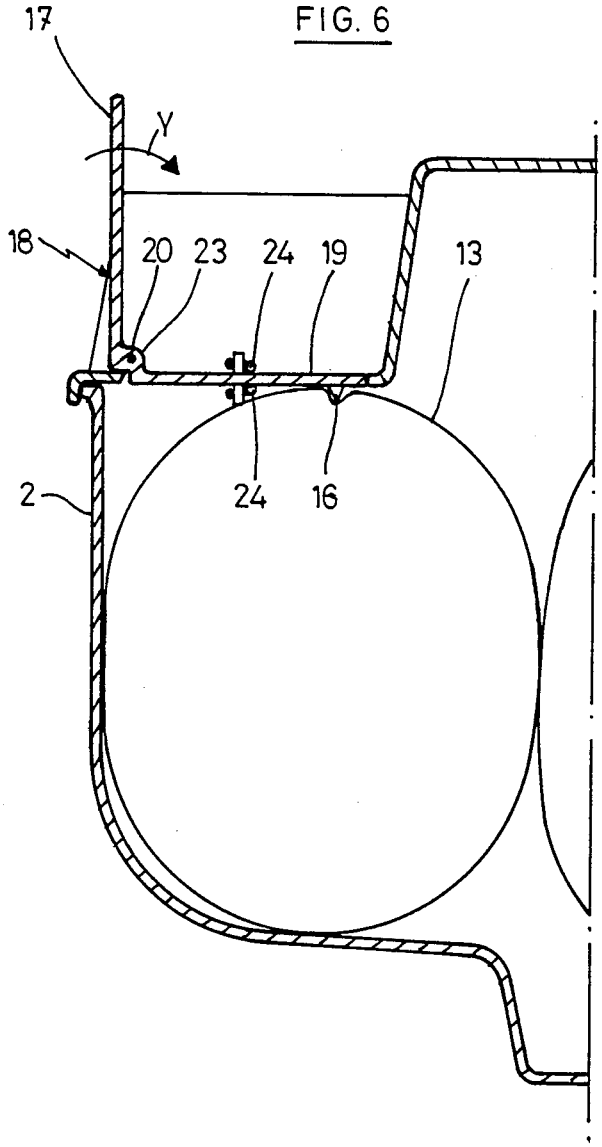

In the embodiment shown in FIGS. 5 and 6, a target 17 is attached to an angle lever 18, preferably both on the port side and on the starboard side of the boat. This lever 18 carries on one arm 19, which may, for example, be triangular, a spur 16 having its free, preferably pointed end directed towards a balloon 13 which serves as float.

When the prow or some other projecting part of an opponent's boat strikes the target 17, the angle lever 18 pivots about coaxial pivots 20 in the direction of the arrow Y. These pivots 20 are mounted on the angle lever 18 and are capable of rotating freely in the eyes 23 formed on the hull 2 of the boat.

When the pivots 20 turn in the direction of the arrow Y, the spur 16 perforates the balloon 13 which serves as float. When the balloon 13 is thus deflated, it leaves room for the entry of water into the hull 2 through an opening (not shown).

An elastic yarn or band 24, which may be in the form of a closed loop, permanently urges the arm 19 of the angle lever 18 into the inoperative position of the lever 18. This elastic band 24 may be attached to the hull 2. A spring could, of course, be provided instead of the band 24.

When the balloon or balloons 13 in the hull 2 of a boat have been burst by the attacks of an opponent's boat, they can easily be replaced by inflated balloons by lifting the superstructure 3. When the balloons have been replaced, the boat is again ready for use for another naval combat.

For such a combat, which may take place, for example, in a swimming pool, each player has remote control devices for moving his boat and attempts to maneuver his boat so as to collide with the opponent's boat in the region of one of the targets (11,15,17) of the latter.

The movements of each boat are remote controlled in known manner by radioelectric waves from an external station controlled by a player and received by the receiver 14 situated in the rear, water-tight and insubmersible compartment 8 of the boat.

The spectacular effect of partial immersion of the boat may be combined with light and/or sound effects such as the explosion of detonators, release of smoke, projection of light flashes.

The form of the hull and the general appearance of the boat may be chosen to imitate the style of any era. Thus, the boat may be in the form of an antique ship, a sampan, a sailing ship, a modern warship, a patrol boat, etc.

What we claim is:

1. A small scale semi-submersible boat for a toy for naval combat between at least two similar boats, said small scale boat comprising :

a hull having a first watertight compartment which is insubmersible and which contains a mechanism for controlling the movement of the boat and a second compartment which is at least partly submersible ;

at least one balloon or caisson serving as a float, which is housed in the second compartment of the hull, which is inflated by means of a gas and which has a perforable wall ;

at least one window serving as a target provided in the hull opposite the perforable wall of a balloon or caisson housed in said second compartment, and a spur carried by the hull and directed outwardly thereof, said spur being able to pierce directly the perforable wall of a balloon or caisson of an opponent's boat through said window, so as to impair the buyoancy of the opponent's boat.

2. A small scale semi-submersible boat for a toy for naval combat between at least two similar boats, said small scale boat comprising :

a hull having a first watertight compartment which is insubmersible and which contains a mechanism for controlling the movement of the boat and a second compartment which is at least partly submersible ;

at least one balloon or caisson serving as a float, which is housed in the second compartment of the hull, which is inflated by means of a gas and which has a perforable wall ;

a spur which is directed towards the interior of the second compartment of the boat, and a target connected to the hull but displaceable in relation to the latter, said target being able to act upon the spur, said spur being able to pierce the perforable wall of the balloon or caisson of the boat under the effect of a thrust exerted on said target by an opponent's boat, so as to impair the buyoancy of the boat.

3. A boat according to claim 2, in which said target is a deformable membrane supporting the spur.

4. A boat according to claim 2, in which the target is attached to a lever which is hinged to the hull and which supports the spur.

5. A boat according to claim 1, comprising at least one target on the port side and/or on the starboard of the boat.

6. A boat according to claim 2, comprising at least one target on the port side and/or on the starboard of the boat.

7. A boat according to claim 1, in which said mechanism response to remote control means known per se.

8. A boat according to claim 2, in which said mechanism response to remote control means known per se.

9. A boat according to claim 3, comprising at least one target on the port side and/or on the starboard of the boat.

* * * * *